US005736995A

United States Patent [19]

Bohorquez et al.

[11] Patent Number: 5,736,995

[45] Date of Patent: *Apr. 7, 1998

[54] TEMPERATURE CONTROL OF THERMAL INKJET PRINTHEADS BY USING SYNCHRONOUS NON-NUCLEATING PULSES

[75] Inventors: Jaime H. Bohorquez, Escondido, Calif.; George H. Corrigan, Corvallis, Oreg.; King-Wah W. Yeung, Cupertino, Calif.

[73] Assignee: Hewlett-Packard Company, Palo Alto, Calif.

[ * ] Notice: The term of this patent shall not extend beyond the expiration date of Pat. No. 5,168,284.

[21] Appl. No.: 520,225

[22] Filed: Aug. 28, 1995

Related U.S. Application Data

[63] Continuation of Ser. No. 144,069, Oct. 27, 1993, abandoned, which is a continuation-in-part of Ser. No. 983,009, Nov. 30, 1992, abandoned, which is a continuation-in-part of Ser. No. 694,185, May 1, 1991, Pat. No. 5,168,284.

[51] Int. Cl.[6] ..... B41J 2/05

[52] U.S. Cl. ..... 347/14; 347/60

[58] Field of Search ..... 347/14, 17, 60, 347/186, 185

[56] References Cited

U.S. PATENT DOCUMENTS

| | | | |
|---|---|---|---|
| 4,490,728 | 12/1984 | Vaught | 347/60 |
| 4,712,172 | 12/1987 | Kiyohara | 347/60 |
| 4,746,937 | 5/1988 | Realis Luc et al. | 347/17 X |
| 4,791,435 | 12/1988 | Smith et al. | 347/17 |
| 4,982,199 | 1/1991 | Dunn | 347/60 X |
| 5,036,337 | 7/1991 | Rizanka | 347/14 |
| 5,107,276 | 4/1992 | Kneezel et al. | 347/60 |
| 5,109,234 | 4/1992 | Otis, Jr. et al. | 347/60 X |
| 5,168,284 | 12/1992 | Yeung | 347/17 |
| 5,381,164 | 1/1995 | Ono | 347/60 X |

FOREIGN PATENT DOCUMENTS

| | | | |
|---|---|---|---|
| 0390202 | 10/1990 | European Pat. Off. | B41J 2/05 |
| 0475638 | 3/1992 | European Pat. Off. | B41J 2/05 |
| 0511602 | 11/1992 | European Pat. Off. | B41J 2/05 |
| 0600648 | 6/1994 | European Pat. Off. | B41J 2/05 |
| 62-117754 | 5/1987 | Japan | B41J 3/04 |

*Primary Examiner*—Joseph W. Hartary
*Attorney, Agent, or Firm*—Dennis G. Stenstrom; David S. Romney

[57] ABSTRACT

A technique for controlling print quality in an inkjet printer by delivering synchronized heating, non-printing pulses and printing pulses to the ink firing resistors during print firing operations such as during the printing of a swath. A temperature of the printhead substrate is measured and compared against a reference temperature during printing operations. If the measured temperature is below the reference temperature, then the printhead substrate is heated during the printing operations to bring the substrate up to the reference temperature. The heating is done by delivering synchronized heating non-printing pulses and printing pulses to the ink firing resistors during selected print firing periods, wherein either the heating pulses or the printing pulses, but not both, occur during a selected print firing period. The heating pulses are logically OR-ed with the printing pulses to achieve the synchronization.

18 Claims, 3 Drawing Sheets

TEMPERATURE CONTROL OF THERMAL INKJET PRINTHEADS BY USING SYNCHRONOUS NON-NUCLEATING PULSES

CROSS-REFERENCE TO RELATED APPLICATIONS

This is a continuation of application Ser. No. 08/144,069, filed Oct. 27, 1993, now abandoned, which is a continuation-in-part of commonly assigned application Ser. No. 07/983,009, filed Nov. 30, 1992, now abandoned, entitled METHOD AND APPARATUS FOR REDUCING THE RANGE OF DROP VOLUME VARIATION IN THERMAL INK JET PRINTERS by Brian P. Canfield, et al., which is a continuation-in-part of Ser. No. 694,185, filed May 1, 1991, U.S. Pat. No. 5,168,284, entitled PRINTHEAD TEMPERATURE CONTROLLER THAT USES NONPRINTING PULSES by King-Wah W. Yeung. The foregoing commonly assigned patent application and commonly assigned patent are hereby incorporated by reference.

FIELD OF THE INVENTION

This invention relates generally to the field of thermal inkjet printers and more particularly to controlling the ejected ink drop volume of thermal inkjet printheads by controlling the temperature of the printhead substrate.

BACKGROUND OF THE INVENTION

Thermal inkjet printers have gained wide acceptance. These printers are described by W. J. Lloyd and H. T. Taub in "Ink Jet Devices," Chapter 13 of *Output Hardcopy Devices* (Ed. R. C. Durbeck and S. Sherr, San Diego: Academic Press, 1988) and U.S. Pat. Nos. 4,490,728 and 4,313,684. Thermal inkjet printers produce high quality print, are compact and portable, and print quickly and quietly because only ink strikes the paper.

An inkjet printer forms a printed image by printing a pattern of individual dots at particular locations of an array defined for the printing medium. The locations are conveniently visualized as being small dots in a rectilinear array. The locations are sometimes "dot locations", "dot positions", or "pixels". Thus, the printing operation can be viewed as the filling of a pattern of dot locations with dots of ink.

Inkjet printers print dots by ejecting very small drops of ink onto the print medium, and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

Color thermal inkjet printers commonly employ a plurality of printheads, for example four, mounted in the print carriage to produce different colors. Each printhead contains ink of a different color, with the commonly used colors being cyan, magenta, yellow, and black. These base colors are produced by depositing a drop of the required color onto a dot location, while secondary or shaded colors are formed by depositing multiple drops of different base color inks onto the same dot location, with the overprinting of two or more base colors producing secondary colors according to well established optical principles.

The typical thermal inkjet printhead (i.e., the silicon substrate, structures built on the substrate, and connections to the substrate) uses liquid ink (i.e., colorants dissolved or dispersed in a solvent). It has an array of precisely formed nozzles attached to a printhead substrate that incorporates an array of firing chambers which receive liquid ink from the ink reservoir. Each chamber has a thin-film resistor, known as a thermal inkjet firing chamber resistor, located opposite the nozzle so ink can collect between it and the nozzle. When electric printing pulses heat the thermal inkier firing chamber resistor, a small portion of the ink next to it vaporizes and ejects a drop of ink from the printhead. Properly arranged nozzles form a dot matrix pattern. Properly sequencing the operation of each nozzle causes characters or images to be printed upon the paper as the printhead moves past the paper.

Print quality is one of the most important considerations of competition in the color inkier printer field. Since the image output of a color inkier printer is formed of thousands of individual ink drops, the quality of the image is ultimately dependent upon the quality of each ink drop and the arrangement of the ink drops on the print medium. One source of print quality degradation is improper ink drop volume.

Drop volume variations result in degraded print quality and have prevented the realization of the full potential of thermal ink jet printers. Drop volumes vary with the printhead substrate temperature because the two properties that control it vary with printhead substrate temperature: the viscosity of the ink and the amount of ink vaporized by a firing chamber resistor when driven with a printing pulse. Drop volume variations commonly occur during printer startup, during changes in ambient temperature, and when the printer output varies, such as a change from normal print to "black-out" print (i.e. where the printer covers the page with dots.)

Variations in drop volume degrades print quality by causing variations in the darkness of black-and-white text, variations in the contrast of gray-scale images, and variations in the chroma, hue and lightness of color images. The chroma, hue and lightness of a printed color depends on the volume of all the primary color drops that create the printed color. If the printhead substrate temperature increases or decreases as the page is printed, the colors at the top of the page can differ from the colors at the bottom of the page. Reducing the range of drop volume variations will improve the quality of printed text, graphics, and images.

Additional degradation in the print quality is caused by excessive amounts of ink in the larger drops. When at room temperature, a thermal ink jet printhead must eject drops of sufficient size to form satisfactory printed dots. However, previously known printheads that meet this performance requirement, eject drops containing excessive amounts of ink when the printhead substrate is warm. The excessive ink degraded the print by causing feathering of the ink drops, bleeding of ink drops having different colors, and cockling and curling of the paper. Reducing the range of drop volume variation would help eliminate this problem.

Thermal InkJet cartridge performance can vary widely due to the temperature of the ink firing chamber and therefore the ejected ink. Due to changes of the physical constants of the ink, the nucleation dynamics and the refill characteristics of a thermal inkjet printhead due to substrate temperature, the control of the temperature is necessary to guarantee consistently good image print quality. The cartridge substrate temperature can vary due to ambient temperature, servicing (spitting) and the amount of printing done with the cartridge.

Heating of the printhead before the start of the printing swath has been used to control substrate temperature. This method has the disadvantage of having to predict the required temperature and adjust the delivered energy at the start of the printing zone to compensate for all possible changes of temperature during the printing swath. Temperature excursions can be great and very difficult to predict. Heating during the printing swath has been tried by adding additional heating elements or additional electronics to energize the print element heaters in parallel with the printing pulses. This method adds to the cost and complexity of the control and power electronics.

For the reasons previously discussed, it would be advantageous to have an apparatus and a method for reducing the range of temperature and drop volume variation by heating the printhead during print.

SUMMARY OF THE INVENTION

The foregoing and other advantages are provided by the present invention which reduces the range of the drop volume variation by maintaining the temperature of the printhead substrate above a minimum value known as the reference temperature. The present invention includes a temperature sense resistor deposited around the firing chamber resistors of the printhead substrate to measure temperature. The present invention includes the steps of selecting a preferred reference temperature that can reduce the range of drop volume variation, measuring the printhead substrate temperature, comparing the printhead substrate temperature with the reference temperature, and keeping the printhead substrate temperature above the reference temperature to reduce the range of drop volume variation.

The present invention includes using a thermal model to estimate the amount of heat to deliver to the printhead substrate to raise its temperature to the reference temperature and delivering this energy during printing swaths.

The present invention includes heating the printhead substrate during the printing of a swath by driving the firing chamber resistors with non-firing pulses synchronized with the firing pulses. The use of non-nucleating pulses synchronized with the printing pulses to control the temperature of the printhead substrate has been shown to dramatically improve the print quality of images printed at all operating conditions including the extremes of printhead parameters. By using synchronized pulses, significant cost and complexity can be reduced as compared to other controlled temperature systems.

DETAILED DESCRIPTION OF THE INVENTION

As discussed above, ink drop volume in an inkjet printer varies with printhead substrate temperature. The present invention reduces the range of drop volume variation by heating the printhead substrate to a reference temperature before printing begins and controlling that temperature during printing by using non-firing pulses synchronized with the firing pulses used to eject printing drops.

Figure 1:
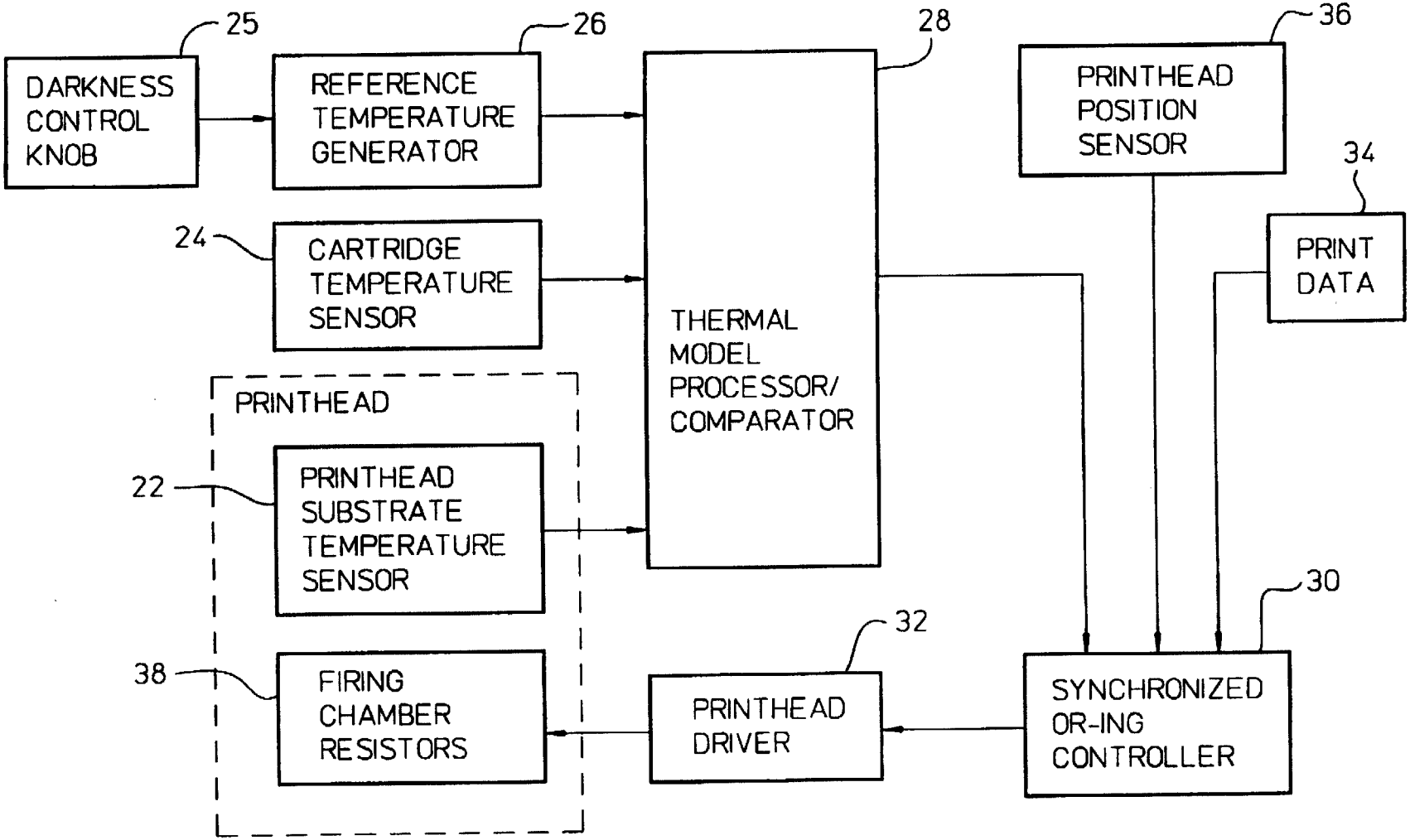
FIG. 1 is a block diagram of the present invention.

FIG. 1 is a block diagram of the preferred embodiment of the present invention. The invention uses a thermal model of the printhead substrate to estimate how long to drive the printhead substrate at a particular power level to raise its temperature to the reference temperature of the printhead substrate. It consists of a printhead substrate temperature sensor 22, a cartridge temperature sensor 24 measures the ambient temperature of the cartridge, and a reference temperature generator 26. The outputs of these three devices are fed into a Thermal Model Processor/Comparator 28 which calculates the non-printing pulse width to apply to the heater resistors. Non-printing pulses are pulses that heat the printhead substrate, but are insufficient to cause nucleation by the firing chamber resistors and eject drops of ink. As used herein, the terms "non-printing," "non-firing," "heating," and "non-nucleating" pulses are synonymous. Also as used herein, firing chamber resistors 38 and heater resistors are synonymous. The output of the Synchronized OR-ing Controller 30 signals a Printhead Driver 32 when to drive the firing chamber resistors 38 with one or more packets of nonprinting pulses having the pulse width specified by the Thermal Model Processor/Comparator 28, based on input from the Print Data Memory 34 and the Printhead Position Sensor 36.

Figure 2:
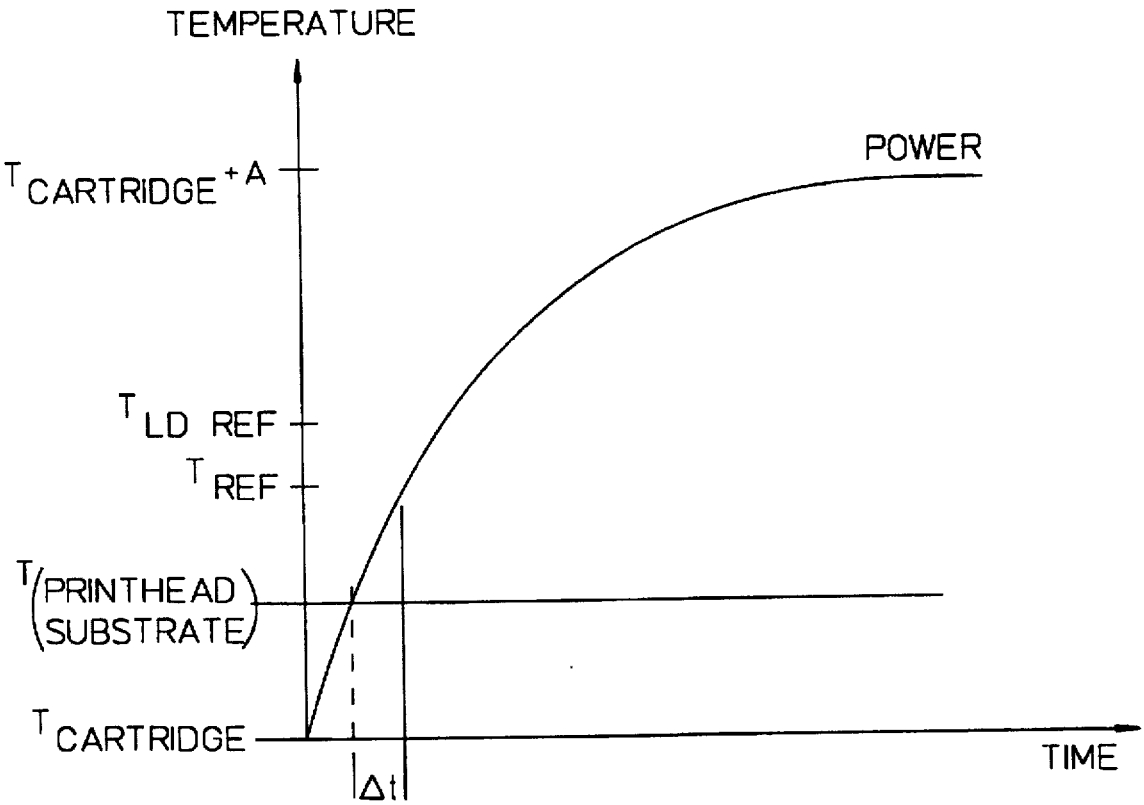
FIG. 2 is a plot of the thermal model of the printhead substrate used by the preferred embodiment of the invention.

FIG. 2 is a plot of the thermal model of the printhead substrate as described in copending commonly assigned application Ser. No. 07/983,009, filed Nov. 30, 1992, entitled METHOD AND APPARATUS FOR REDUCING THE RANGE OF DROP VOLUME VARIATION IN THERMAL INK JET PRINTERS which is incorporated herein by reference. As set forth above, the inputs to the thermal model include the reference temperature, the cartridge temperature (i.e., the temperature of the air inside the cartridge that surrounds the printhead substrate,) and the printhead substrate temperature. The output parameter, $\Delta t$, shown in FIG. 2 is the length of time the firing chamber resistors 38 should be driven at power P to heat the printhead substrate to the reference temperature.

Figure 3:
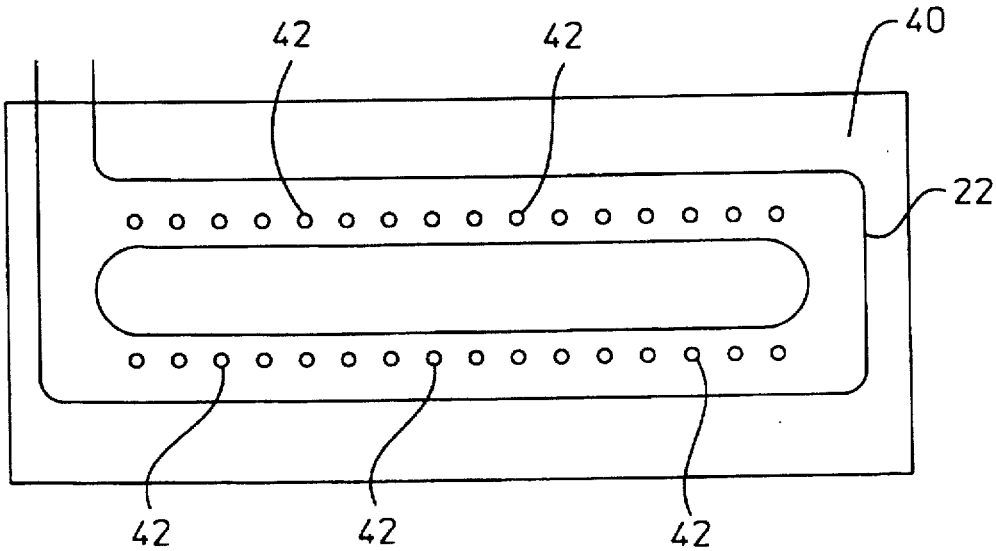
FIG. 3 shows the temperature sense resistor for the preferred embodiment of the present invention.

FIG. 3 shows the temperature sense resistor 22 used by the invention. Temperature sense resistor 22 measures the average temperature of a printhead substrate 40 since it wraps around all nozzles 42 of printhead substrate 40. The temperature of the ink in the drop generators is the temperature of greatest interest, but this temperature is difficult to measure directly, so temperature sense resistor 22 measures it indirectly. The silicon is thermally conductive and the ink is in contact with the substrate long enough that the temperature averaged around the head is very close to the temperature of the ink by the time the printhead ejects the ink.

The output of the printhead substrate temperature sensor 22 is compared to the reference temperature output of reference temperature generator 26 by the Thermal Model Processor/Comparator 28. If the printhead substrate temperature is less than the reference temperature, the Thermal Model Processor/Comparator 28 will enable heating pulses and send the heating pulse width to the Synchronizing OR-ing Controller 30. This process is repeated as required during the print cycle.

The advantage of the thermal model is that the printhead substrate reaches the reference temperature with reduced iterations of measuring the printhead substrate temperature and heating the printhead substrate. However, the thermal model is part of a closed-loop system and the system may use several iterations of measuring and heating if needed.

The present invention, sets the reference temperature equal to an average print cycle temperature $T_{APCT}$ as described in the above referenced application Ser. No. 07/983,009. This has the advantage of eliminating half the temperature range and half the range of drop volume variation due to temperature variation. Alternate embodiments could set the reference temperature equal to any temperature, such as above the maximum temperature, equal to the maximum temperature, somewhere between $T_{ACPT}$ and the maximum temperature, or below $T_{APCT}$ without departing from the scope of the invention.

Raising the reference temperature has the advantage of reducing the range of printhead substrate temperature variation and if the reference temperature equals the maximum temperature, the printhead substrate temperature will not vary at all. But raising the reference temperature places increased stress on the printhead substrate and the ink and the likelihood of increased chemical interaction of the ink and the printhead substrate. This results in decreased reliability of the printhead. Also, a printhead substrate with a higher reference temperature will require more time for heating. Another disadvantage of raising the reference temperature is that all ink jet printer designs built to date have shown a higher chance of misfiring at higher printhead substrate temperatures.

The printhead substrate is heated to the reference temperature only during the print cycle. This has the advantage of keeping the printhead substrate at lower and less destructive temperatures for longer. The temperature of the printhead substrate is measured as it moves across the paper. If the substrate temperature is below the reference temperature the printer will send either a printing pulse if the plot requires it or a nonprinting pulse as described below.

Another aspect of the invention, is a darkness control knob 25, shown in FIG. 1, that allows the user to change the reference temperature and thereby adjust the darkness of the print or the time required for the ink to dry according to personal preference or changes in the cartridge performance. Adjustments of the darkness control knob 25 can cause the reference temperature to exceed the maximum temperature.

The preferred embodiment of the invention heats the printhead substrate by using packets of nonprinting pulses. The power delivered by these packets equals the number of nozzles times the frequency of the nonprinting pulses (which can be much higher than that of the printing pulses since no drops are ejected from the printhead) times the energy in each nonprinting pulse. This power parameter is used to create the thermal model shown in FIG. 2. The number of nozzles and the frequency of the nonprinting pulses are constant and set by other aspects of the printhead design. Alternate embodiments of the invention can vary the frequency of the nonprinting pulses and pulse some but not all of the nozzles without departing from the scope of the invention.

In the preferred embodiment of the invention, the nonprinting pulses have the same voltage as the printing pulses so that the various time constants in the circuit are the same for printing pulses and nonprinting pulses. The pulse width and energy delivered by printing pulses are adjusted according to the characteristics of each particular printhead. The width of nonprinting pulses is equal to or less than 0.48 times the width of the printing pulse so that it has little chance of ever ejecting ink from the printhead.

By applying non-nucleating pulses to the heater elements during periods of inactivity the substrate temperature can be controlled. The complexity of the control electronics can be significantly reduced and printhead operation can be improved if the pulses normally used to eject printing drops are reduced in width when used as heating pulses. The print pulses can be extended to the pulse width required to eject a drop when printing is required. By simple control of the pulse width of the non-nucleating pulses the temperature of the substrate can be increased or lowered as required. Increasing the pulse width increases the substrate temperature and decreasing the pulse width lowers the substrate temperature.

Figure 4A:
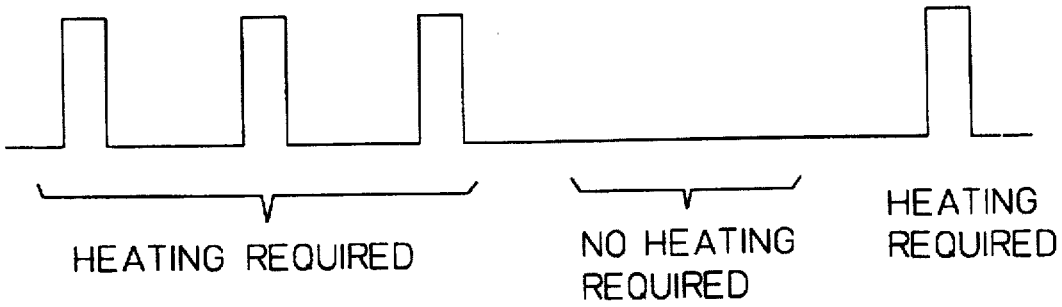
FIGS. 4A, 4B and 4C show the composite pulse waveform generated by OR-ing the heating pulses and printing pulses.
Figure 4B:
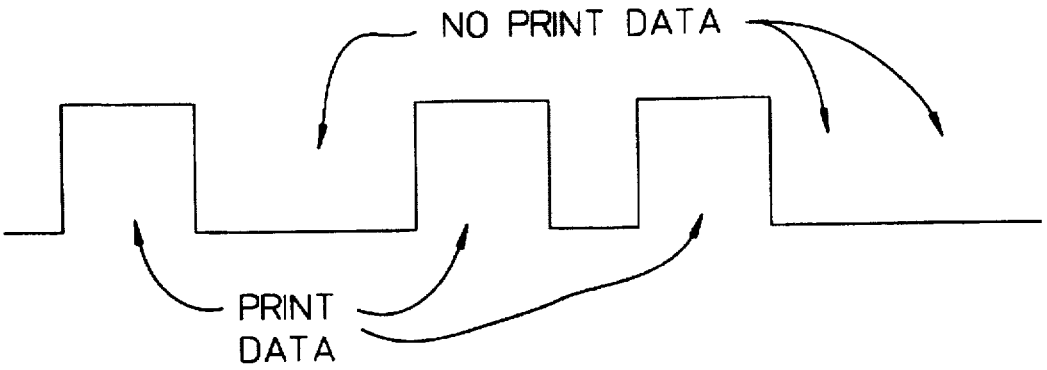
Figure 4C:
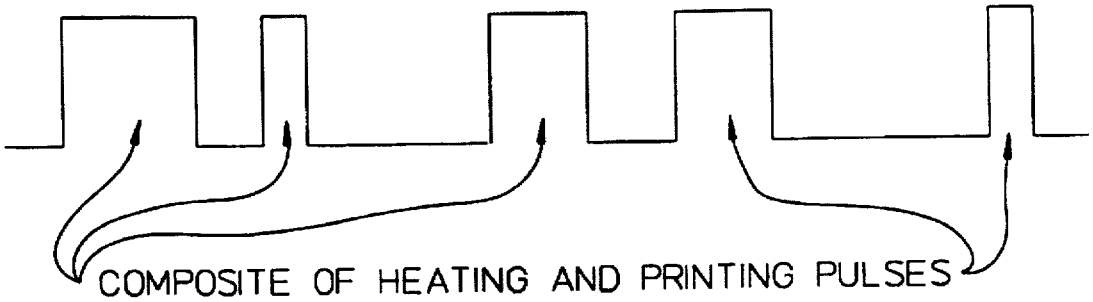

Heating pulses synchronized with the printing pulses can be generated by combining (OR-ing) the data for the heating pulses and the printing pulses in the Synchronizing OR-ing Controller 30 during each firing cycle. At each firing period either the heating pulse width, or the printing pulse width is applied. By Or-ing the data, the excess heating of the substrate is only applied during the non-firing periods. This method allows all elements of the printhead to be used for both printing and warming with minimal additional electronics. By using all the elements to heat the substrate, a more even temperature over the whole substrate is achieved. FIGS. 4A to 4C shows an example of the printing and heating pulses for a particular firing chamber resistor 38. FIG. 4A shows the heating pulses and the heating pulse width to be sent to the firing chamber resistor 38. FIG. 4B shows the printing pulses and the printing pulse width to be sent to the firing chamber resistor 38. FIG. 4C shows the printing pulses and heating pulses to be sent to the firing chamber resistor 38 as a result of the OR-ing process.

In summary, the preferred embodiment uses a thermal model of the printhead substrate, having inputs of the reference temperature, the cartridge temperature, and the printhead substrate temperature, that calculates how long the firing chamber resistors 38 of the printhead substrate 40 should be driven with packets of nonprinting pulses of a specified power, to the printhead substrate during printing swaths to raise the printhead substrate temperature to the reference temperature.

All publications and patent applications cited in the specification are herein incorporated by reference as if each publication or patent application were specifically and individually indicated to be incorporated by reference.

The foregoing description of the preferred embodiment of the present invention has been presented for the purposes of illustration and description. It is not intended to be exhaustive nor to limit the invention to the precise form disclosed. Obviously many modifications and variations are possible in light of the above teachings. The embodiments were chosen in order to best explain the best mode of the invention. Thus, it is intended that the scope of the invention be defined by the claims appended hereto.

What is claimed is:

1. A method for controlling print quality in an inkier printer that includes a printhead having a printhead substrate and ink firing resistors disposed on the printhead substrate, comprising the steps of:

selecting a reference temperature;

measuring a temperature of the printhead substrate;

comparing the printhead substrate temperature with the reference temperature to determine if the substrate temperature is below the reference temperature; and if so, then heating the printhead substrate to the reference temperature periodically during print firing operations by delivering synchronized heating pulses or printing pulses to the ink firing resistors during selected print firing periods wherein either said heating pulses or said printing pulses,,but not both, occur during such a selected print firing period.

2. The method of claim 1 wherein the step of heating includes the steps of:

generating a heating signal that includes non-firing heating pulses;

generating a print signal that contains printing pulses; and logically OR-ing the heating signal and the print signal to produce the synchronizing heating pulses and printing pulses.

3. The method of claim 1 wherein there are no non-firing heating pulses which occur at non-synchronous intervals.

4. The method of claim 3 wherein there are no non-firing heating pulses which occur at non-synchronous intervals relative to said synchronized heating pulses and printing pulses.

5. The method of claim 1 which further includes the step of generating heating pulses have a predetermined pulse width less than half of an actual pulse width for said print pulses.

6. The method of claim 1 which further includes the step of maintaining a given voltage for both said heating pulses and said printing pulses.

7. The method of claim 6 which further includes providing a variable predetermined pulse width for said heating pulses.

8. The method of claim 7 wherein said variable predetermined pulse width is based on the reference temperature, the substrate temperature, and an ambient printhead temperature.

9. The method of claim 1 wherein the inkjet printer is a swath printer, and said step of heating the printhead substrate to the reference temperature periodically occurs during the printing of a swath.

10. An inkjet printer comprising:

an inkjet printhead including a substrate and ink firing resistors formed in an array of firing chambers on said substrate;

a printhead substrate temperature sensor to monitor an operating temperature of ink in said firing chambers of said firing resistors in order to determine an operating temperature output;

means for generating a reference temperature which constitutes a preferred predetermined minimum value for said operating temperature; and pulse generating means responsive to said output of said printhead temperature sensor and to said reference temperature for driving each of said ink firing resistors with a print signal during a plurality of print periods, said print signal containing during each of selected print periods when said operating temperature output is below said reference temperature a single pulse that is either an ink firing print pulse or a non-firing heating pulse.

11. The inkjet printer of claim 10 wherein said pulse generating means comprises:

means for generating a heating signal that includes non-firing heating pulses;

means for generating a print signal that includes print pulses; and means for logically OR-ing said heating signal and said print signal to produce said single pulse.

12. The inkjet printer of claim 11 wherein said logically OR-ing means includes a controller for synchronizing said non-firing heating pulses and said print pulses.

13. The inkjet printer of claim 11 wherein said heating signal and said print signal have the same voltage.

14. The inkjet printer of claim 10 wherein said non-firing heating pulses have a first predetermined pulse width; and which printer further includes a processing device to change said first predetermined pulse width of said non-firing heating pulses.

15. The inkjet printer of claim 14 wherein said print pulses have a second predetermined pulse width which is greater than said first predetermined pulse width.

16. The inkjet printer of claim 15, wherein said print pulses have a second predetermined pulse width which is more than two times greater than said first predetermined pulse width.

17. The inkjet printer of claim 10 which further includes a user activated control coupled to said reference temperature generator to change the reference temperature.

18. The printer of claim 10 wherein said printer is a swath printer, and said plurality of print periods occurs during the printing of a swath.

* * * * *

UNITED STATES PATENT AND TRADEMARK OFFICE

CERTIFICATE OF CORRECTION

PATENT NO. : 5,736,995

DATED : April 7, 1998

INVENTOR(S) : Bohorquez et al.

It is certified that error appears in the above-indentified patent and that said Letters Patent is hereby corrected as shown below:

At Column 6, line 51, delete "inkier" and insert in lieu thereof --inkjet--.

Signed and Sealed this

Twenty-first Day of July, 1998

Bruce Lehman

*Attest:*

BRUCE LEHMAN

*Attesting Officer*

*Commissioner of Patents and Trademarks*